United States Patent [19]

Baker et al.

[11] 4,260,164

[45] Apr. 7, 1981

[54] INFLATABLE PACKER ASSEMBLY WITH CONTROL VALVE

[75] Inventors: Eugene E. Baker; Ernest E. Carter, Jr., both of Duncan, Okla.

[73] Assignee: Halliburton Company, Duncan, Okla.

[21] Appl. No.: 48,977

[22] Filed: Jun. 15, 1979

Related U.S. Application Data

[63] Continuation-in-part of Ser. No. 8,774, Feb. 2, 1979.

[51] Int. Cl.[3] ..... E21B 33/12

[52] U.S. Cl. ..... 277/34; 137/68 R; 137/70; 137/461; 137/613; 166/187

[58] Field of Search ..... 137/68, 70, 456, 461, 137/613; 277/34, 34.3; 166/187

[56] References Cited

U.S. PATENT DOCUMENTS

| | | | |
|---|---|---|---|
| 3,542,127 | 11/1970 | Malone | 277/34 |
| 3,749,119 | 7/1973 | Tausch et al. | 137/461 |
| 3,779,263 | 12/1973 | Edwards | 137/68 R |
| 3,818,922 | 6/1974 | Malone | 137/70 |
| 3,826,309 | 7/1974 | Tausch | 137/461 |

*Primary Examiner*—Robert I. Smith

*Attorney, Agent, or Firm*—John H. Tregoning; James R. Duzan; Lucian Wayne Beavers

[57] ABSTRACT

An inflatable packer assembly includes a cylindrical mandrel with a cylindrical valve body concentrically disposed about the mandrel. The valve body includes an inlet communicating with an interior of the mandrel and an outlet for directing fluid to an inflatable element of the packer assembly. First and second axial bores, containing first and second pistons, respectively, are disposed in said valve body and communicate with an end surface thereof. The first bore also communicates with said inlet. A first port connects the first and second bores. A second port connects the second bore and the outlet. The first piston is held in a first position blocking said first port until a pressure differential across the first piston reaches a first level at which the first piston is released and is moved to a second position allowing fluid communication between the inlet and the first port. The second piston is held in a first position allowing fluid communication between said first and second ports until a pressure differential across said second piston reaches a second level, higher than said first level, at which said second piston is released and is moved to a second position blocking said second port.

14 Claims, 10 Drawing Figures

INFLATABLE PACKER ASSEMBLY WITH CONTROL VALVE

This application is a continuation-in-part of our copending U.S. patent application Ser. No. 008,774 filed Feb. 2, 1979.

This invention relates generally to an inflatable packer assembly for use with a casing or other tubular member of a well, and more particularly, but not by way of limitation to a control valve for use with such a packer assembly or other downhole tool.

An inflatable packer is a downhole tool which can be inflated with well fluid to seal off the annular space between, for example, the casing and the wellbore. It may also be used inside a casing.

Inflatable packers may be used in a well for a variety of reasons. They can be used to support a column of cement above a lost circulation zone. They can be used to isolate producing zones from cementing operations. Also, they may be used to isolate production and lost circulation zones for gravel pack operations.

Typical prior art control valves for inflatable packers have included both spring loaded check valves, and various forms of sliding sleeve valves, for controlling the flow of well fluid to the inflatable element to inflate the same.

Examples of spring loaded check valves are disclosed in U.S. Pat. Nos. 3,437,142 to Conover, 3,085,628 to Malone, and 2,177,601 to Smith. Examples of sliding sleeve valves are disclosed in U.S. Pat. No. 3,524,503 to Baker and U.S. Pat. No. 3,053,322 to Kline.

The present invention provides an improved inflatable packer assembly having a cylindrical mandrel with a cylindrical valve body concentrically disposed about the mandrel. The valve body includes an inlet communicating with an interior of the mandrel and an outlet means for directing fluid to an inflatable element of the packer assembly. First and second axial bores, containing first and second pistons, respectively, are disposed in said valve body and communicate with an end surface thereof. The first bore also communicates with said inlet. A first port means connects the first and second bore means. A second port means connects the second bore means and the outlet. The first piston is held in a first position blocking said first port means until a pressure differential across the first piston reaches a first level at which the first piston is released and is moved to a second position allowing fluid communication between the inlet and the first port means. The second piston is held in a first position allowing fluid communication between said first and second port means until a pressure differential across said second piston reaches a second level, higher than said first level, at which said second piston is released and is moved to a second position blocking said second port means.

FIG. 1 is a schematic partly sectional elevation illustration of the inflatable packer assembly with control valve of the present invention in place within an oil well borehole.

FIGS. 2A–2C comprise an enlarged sectional elevation view of the inflatable packer assembly with control valve of FIG. 1.

Figure 1:
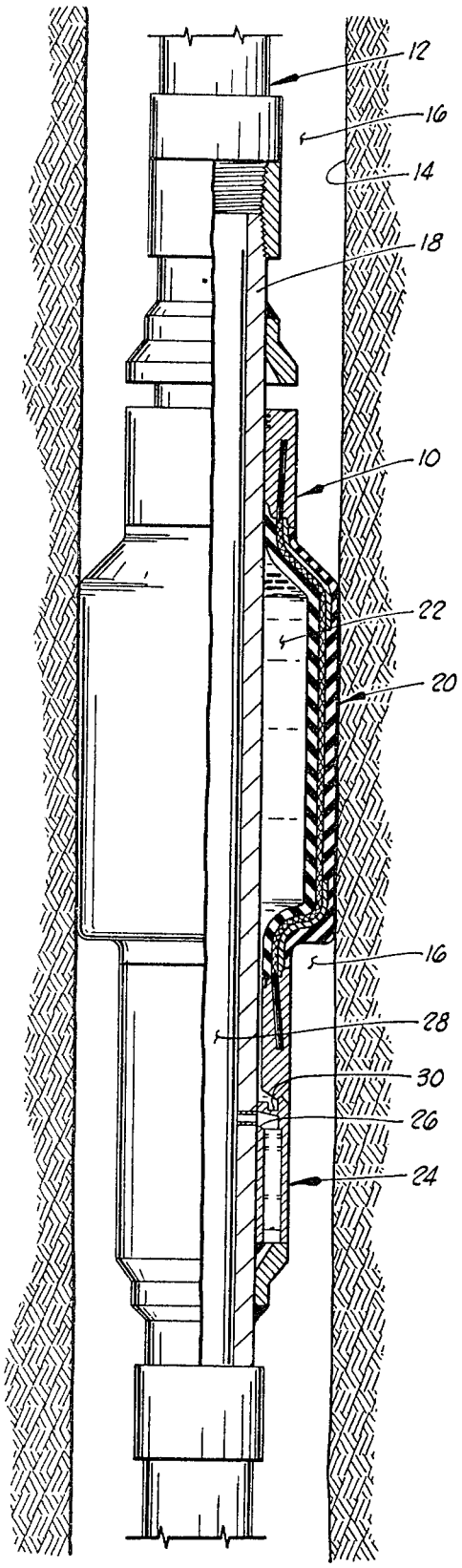

Referring now to the drawings, and particularly to FIG. 1, the inflatable packer assembly of the present invention is shown and generally designated by the numeral 10. The inflatable packer assembly 10, which may more generally be referred to as a downhole tool, is generally connected as an integral part of a casing string 12, which may generally be referred to as a tubular member. The casing string 12 is disposed in a borehole or well hole 14 of an oil well so that there is an annular cavity or space 16 between casing string 12 and well hole 14. It will be understood by those skilled in the art, that the present invention could be equally well applied to a downhole tool connected to a drill string located within a well hole defined by an inner surface of a well casing.

The inflatable packer assembly 10 includes a cylindrical mandrel 18 having an inflatable element which may be referred to as a bladder means or packer 20 connected to the mandrel 18 for sealing said annular cavity 16. The bladder means 20 and the mandrel 18 define an annular fluid-filled space 22 therebetween when said bladder means 20 is inflated to seal said cavity 16.

A valve means generally designated by the numeral 24 includes an inlet 26 communicating with an interior of tubular member 12 through an interior 28 of said mandrel 18, and an outlet 30 communicating said annular space 22. The valve means 24 communicates said interior 28 of said mandrel 18 with said annular space 22 when a fluid pressure differential between said interior 28 of said mandrel 18 and said cavity 16 adjacent a lower end 54 of said valve means 24 reaches a first predetermined level, so that fluid from said interior 28 flows into said annular space 22 to inflate said bladder means 20 as illustrated in FIG. 1.

The valve means 24 also includes a means for isolating said interior 28 from said annular space 22 when said pressure differential reaches a second level higher than said first level, while preventing any loss of fluid from said annular space 22 as said interior 28 is being isolated therefrom.

Figure 2A:
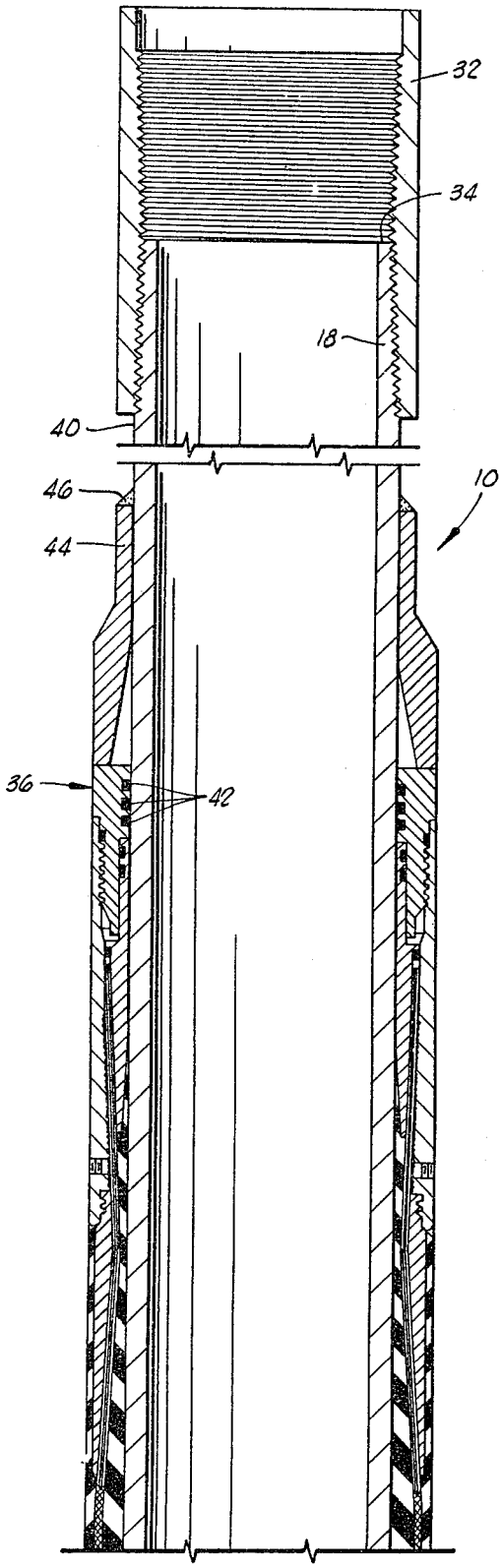
Figure 2B:
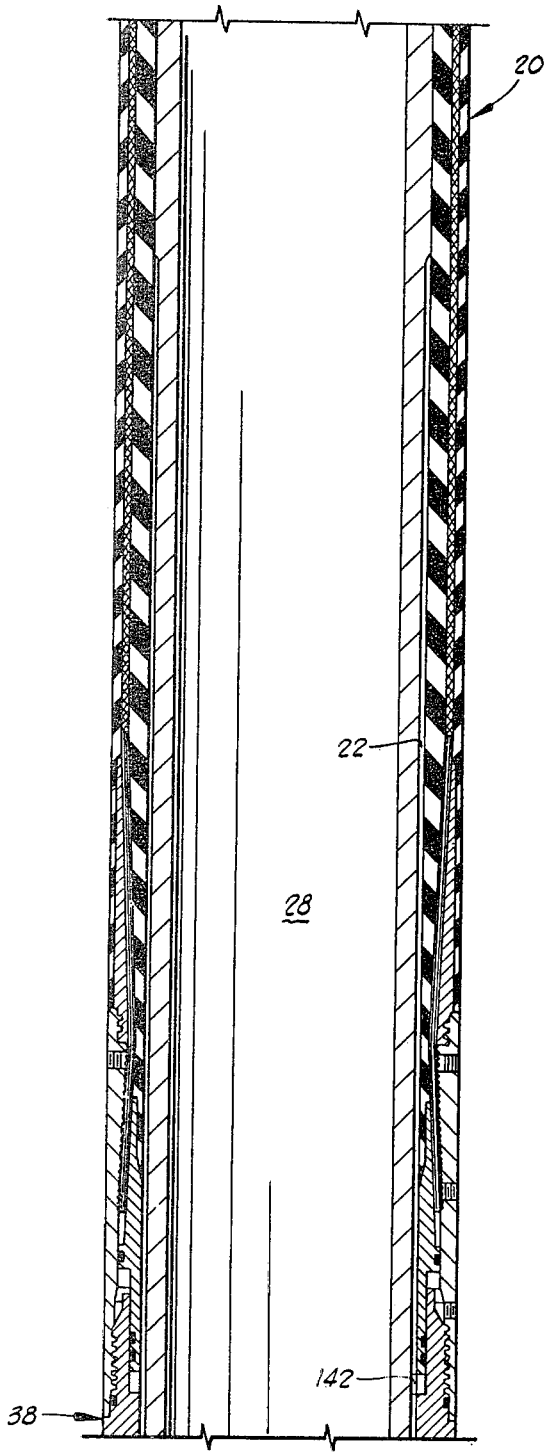
Figure 2C:
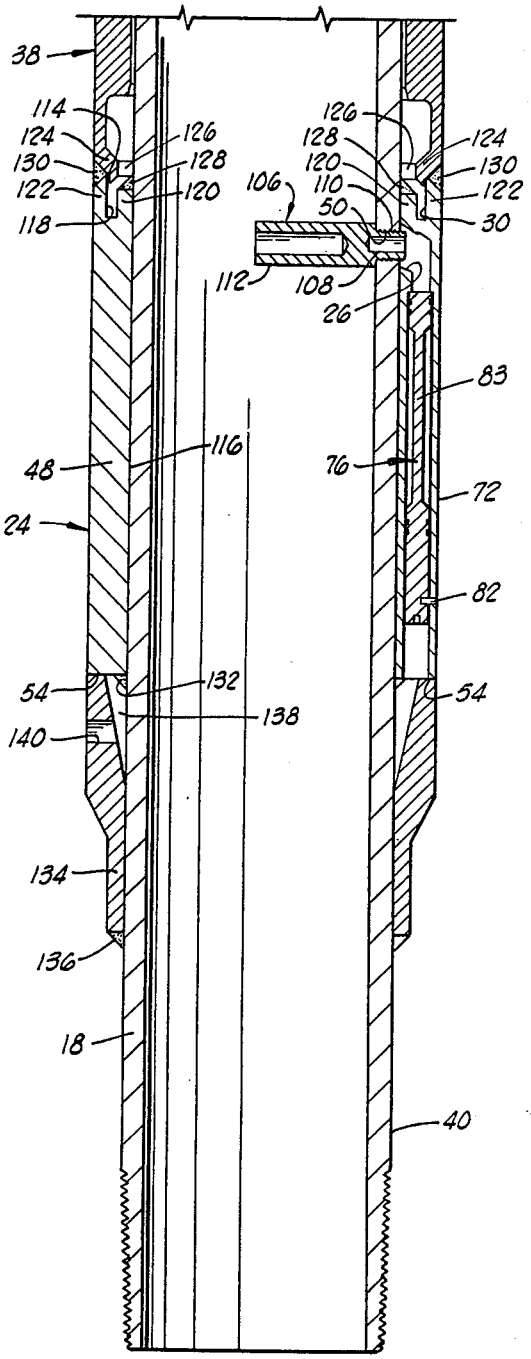

Referring now to FIGS. 2A–2C, the inflatable packer assembly 10 includes an upper body 32 threadedly connected to an upper end 34 of mandrel 18 for connecting mandrel 18 to the casing string 12.

The bladder means 20 is connected at its upper and lower ends to upper and lower packer shoes 36 and 38, respectively.

Upper packer shoe 36 sealingly engages an outer cylindrical surface 40 of mandrel 18 with a plurality of O-rings 42. When bladder means 20 is in the uninflated position shown in FIG. 2 the upper packer shoe 36 abuts an upper backup ring 44. Upper backup ring 44 is welded to outer cylindrical surface 40 of mandrel 18 as indicated at 46.

Valve means 24 includes a cylindrical valve body 48 concentrically disposed about outer surface 40 of mandrel 18. The cylindrical valve body 48 includes the inlet 26 which is permanently aligned with a hole 50 disposed through a wall of said mandrel 18 and communicating with said interior 28 of mandrel 18.

Valve body 24 also includes the outlet 30 for directing fluid from the interior 28 to the annular fluid-filled space 22 of bladder means 20. Bladder means 20 may also be referred to as a component of the downhole tool which is to be actuated by said fluid from the interior of mandrel 18.

Figure 3:
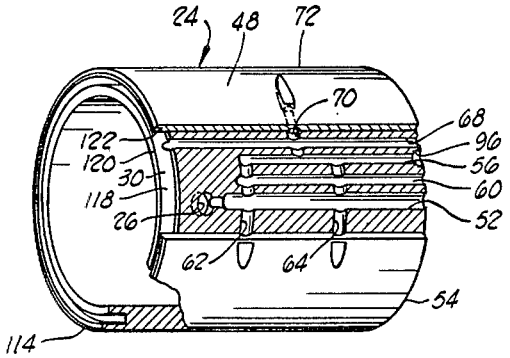
FIG. 3 is an isometric view of the control valve with a portion of the wall thereof removed to show the piston bores and interconnecting ports.
Figure 4:
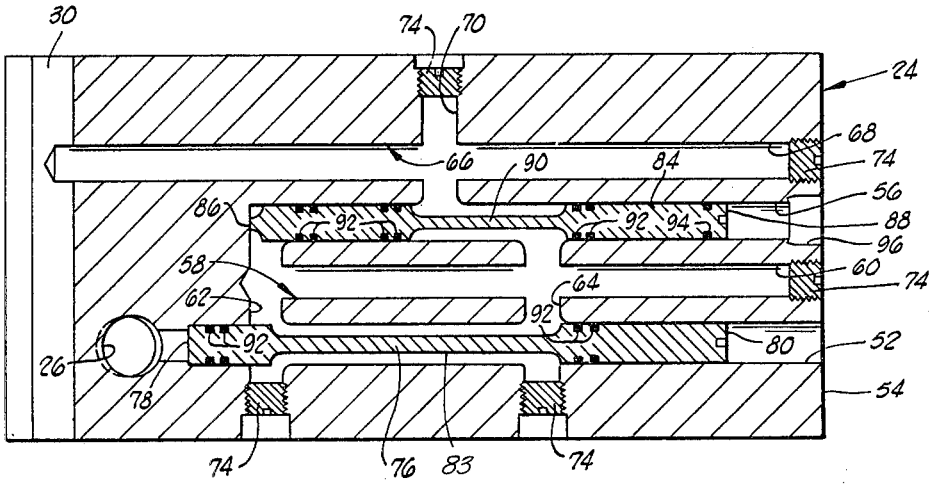
FIG. 4 is a schematic representation of the piston bores and ports of the valve of FIG. 3.

As is best seen in FIGS. 3 and 4, the valve body 48 further includes a first axial bore 52 connecting said inlet 26 with an end surface 54 of said cylindrical valve body 48. Valve body 48 also includes a second axial bore 56 communicating with said end 54 of valve body 48. End surface 54 communicates with the annular space 16 about outer cylindrical surface 40 of mandrel 18.

A first port means, generally designated by the numeral 58, interconnects said first and second bores 52 and 56. First port means 58 comprises a third axial bore 60 which is intersected by first and second crossbores 62 and 64. Crossbores 62 and 64 also intersect first and second axial bores 52 and 56.

A second port means, generally indicated by the numeral 66 interconnects second bore 56 with outlet 30. Second port means 66 comprises a fourth axial bore 68 connecting first end 54 of valve body 24 with outlet 30. Second port means 66 further comprises a third crossbore 70 intersecting second and fourth axial bores 56 and 68.

Those ends of third and fourth axial bores 60 and 68, and of first, second and third crossbores 62, 64 and 70, which communicate with first end 54 of valve body 48 or with radially outer surface 72 of valve body 48 are sealed after being drilled, with pipe plugs 74 as shown in FIG. 4.

A first or primary piston 76 is slidably disposed in first bore 52. First piston 76 has first and second ends 78 and 80, respectively, which are in fluid communication with said inlet 26 and said first end 54 of valve body 48, respectively.

First piston 76 is movable between a first position, illustrated in FIG. 4, blocking said first port means 58 and a second position (displaced to the right from the position shown in FIG. 4 so as to abut lower backup ring 134) allowing fluid communication between said inlet 26 and said first port means 58. When first piston 76 is in said second position, the first end 78 is displaced to the right past first crossbore 62, so that inlet 26 is communicated with first crossbore 62.

Referring to FIG. 2C the first piston 76 is thereshown in its first position. First piston or primary piston 76 is connected to valve body 48 by a first shear pin 82. Shear pin 82 may be referred to as a means for holding first piston 76 in said first position until a fluid pressure differential between interior 28 of mandrel 18 and said first end 54 of valve body 48, i.e. annular space 16, reaches a first level, and for releasing first piston 76 so that it may be moved to said second position by said pressure differential when said differential reaches said first level.

First piston 76 includes a reduced diameter portion 83, between first and second ends 78 and 80 thereof. It is very difficult to manufacture a long bore of relatively small diameter, such as first bore 52, which is absolutely straight. The bore 52 generally will have some very slight curve or other irregularity from the desired straight line of bore. The reduced diameter portion 83 of first piston 76 gives piston 76 sufficient flexibility so that it may bend slightly to accommodate such irregularities in bore 52 when piston 76 is moving between its said first and second positions within bore 52. This provides an advantage over a constant diameter piston which would have more of a tendency to become stuck within an irregular bore.

A second piston 84 is slidably disposed in second bore 56. Second piston 84 includes first and second ends 86 and 88, respectively. The first end 86 is in fluid communication with first port means 58 and second end 88 is in fluid communication with said first end 54 of valve body 48 which communicates with annular space 16.

Second piston 84 is movable between a first position, illustrated in FIG. 4, allowing fluid communication between said first and second port means 58 and 66, respectively, and a second position (displaced to the right from that shown in FIG. 4 so as to block third crossbore 70) blocking said second port means 66.

Second piston 84 includes a middle portion 90 of reduced diameter, so that when second piston 84 is in said first position said first and second port means 58 and 66 are communicated through said second bore 56 around said reduced diameter middle portion 90 of second piston 84.

Second piston 84 is connected to valve body 48, when in the first position illustrated in FIG. 4, by a shear pin (not shown) similar to shear pin 82. The shear pin connecting second piston 84 to the valve body 48 may also be referred to as a means for holding said second piston 84 in said first position until said fluid pressure differential between said interior 28 and said first end 54 of valve body 48 reaches a second level, said second level being higher than said first level, and for releasing said second piston 84 so that it may be moved to its said second position by said pressure differential when said pressure differential reaches said second level.

First and second pistons 76 and 84 each include a plurality of O-rings 92 for sealing against their respective bores 52 and 56.

Second piston 84 includes an outer annular groove containing an expandable metal retaining ring 94. When second piston 84 is displaced to the right from the position shown in FIG. 4 to its second position, retaining ring 94 expands and engages a counterbore 96 which is concentric with second bore 56 and communicates with first end 54 of valve body 24. This locks second piston 84 into said second position, and permanently and automatically isolates interior 28 from the annular space 22 when the pressure differential reaches said second level.

Figure 5:
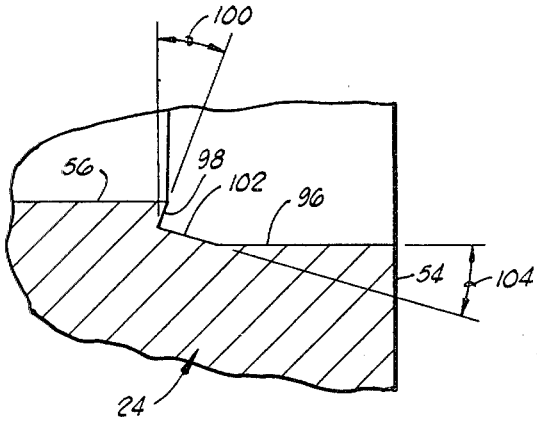
FIG. 5 is an enlarged view of the counterbore 96 of second bore 56 of the valve of FIG. 3.

Referring to FIG. 5 the details of construction of counterbore 96 are illustrated. A shoulder 98 between second bore 56 and counterbore 96 is cut at an angle 100 to a plane normal to the longitudinal axis of bore 56. The angle 100 is preferably approximately 20°. Shoulder 98 is joined to counterbore 96 by a tapered surface 102 which is tapered at an angle 104 to the longitudinal axis of counterbore 56. The angle 104 is preferably approximately 15°. This construction of the counterbore 96 is preferable for aiding expandable retaining ring 94 in locking itself in counterbore 96.

As shown in FIG. 2C a removable knock-out plug 106 is engaged with and blocks hole 50 in the wall of mandrel 18. Knock-out plug 106 includes a tubular portion 108 having external threads 110 engaging said hole 50. Knock-out plug 106 also includes an extension 112 projecting radially into said interior 28 of mandrel 18. Knock-out plug 106 is constructed so that extension 112 may be broken or sheared off by a force from above.

The extension 112 is generally sheared off by pumping a cement plug down the interior of casing 12 and mandrel 18 or by running some other tool on a drill string down the casing 12 so as to strike knock-out plug 106 and shear off extension 112.

The knock-out plug 106 is so constructed that when extension 112 is sheared off it shears at a point within hole 50 so that there are no sharp edges projecting into interior 28 of mandrel 18 which might cut swab cups or the like being moved through casing 12.

When extension 112 is sheared off of knock-out plug 106 this allows fluid communication between interior 28 and the inlet 26 of valve body 48 through the tubular portion 50 of knock-out plug 106.

The valve means 24 is so constructed that it may be very easily assembled with the mandrel 18. The valve means includes the cylindrical valve body 48 having the first end 54 and a second end 114.

A constant diameter cylindrical inner surface 116 of valve body 48 innerconnects said first and second ends 54 and 114, respectively. The cylindrical outer surface 40 of mandrel 18 is closely received within said cylindrical inner surface 116 of valve body 48 and such cylindrical outer surface 40 of mandrel 18 extends past each of said first and second ends 54 and 114 of said valve body 48.

The outlet 30 of valve means 24 includes an annular axially extending groove 118 disposed in said second end 114 of valve body 48. Axially extended groove 118 defines radially inner and outer axially extending concentric tongues 120 and 122, respectively.

A portion 124 of lower annular packer shoe 38 adjacent said second end 114 of valve body 48 is radially spaced from said outer cylindrical surface 40 of mandrel 18 forming an annular passage 126 communicating with said annular groove 118 of said outlet 30 of said valve means 24.

The inner tongue 120 of first end 114 of valve body 48 is welded to said radially outer surface 40 of mandrel 18 as indicated at 128. Radially outer tongue 122 of first end 114 of valve body 48 is welded to said lower annular packer shoe 38 as indicated at 130. This construction provides the strength of full ¼ inch fillet welds at 128 and 130, while also providing a large flow area by the intersection of groove 118 and annular passage 126.

First end 54 of valve body 48 is welded to outer cylindrical surface 40 of mandrel 18 as indicated at 132. First end 54 of valve body 48 engages a lower backup ring 134 which itself is welded to mandrel 18 at 136.

An upper portion of lower backup ring 134 is radially spaced from outer surface 40 of mandrel 18 so as to define an annular space 138 which communicates with first end 54 of valve body 48 and with first and second bores 52 and 56. A relief bore 140 communicates annular space 138 with the cavity 16 between mandrel 18 and borehole 14.

The modular construction of the inflatable packer assembly 10 described above allows a variety of different weight ranges of the packer assembly 10 to be constructed using the same packer or bladder means 20 and the same valve means 24. All that is required to vary the design capacity of the inflatable packer assembly 10 is to vary the weight of the mandrel 18. This greatly reduces the cost of manufacture of the inflatable packer assembly 10 as compared to proir art designs wherein the valve means was constructed integrally with a portion of the casing or of the mandrel.

The operation of the inflatable packer assembly 10 is as follows. The inflatable packer assembly 10 is constructed and assembled as illustrated in FIGS. 1 and 4 with the first and second pistons 76 and 84 in their first positions with the shear pins in place. The inflatable packer assembly 10 is then attached as an integral part of casing 12 as illustrated in FIG. 1 and is lowered into the borehole 14 until the packer 20 is adjacent the location where it is desired to seal the cavity 16 between the casing 12 and the borehole 14.

To prevent premature inflation of the packer or bladder means 20 while running the casing 12 into the hole 14, the hole 50 and inlet 26 are blocked by the knock-out plug 106.

Once the casing is properly positioned and it is desired to inflate the packer 20, the extension 112 is sheared off of the knock-out plug 106 to allow fluid from interior 28 of the mandrel 18 to enter inlet 26.

In a preferred embodiment of the present invention, once the knock-out plug 106 is removed the first piston 76 will remain in its first position until a pressure differential across that first piston, i.e. a pressure differential between the interior 28 of mandrel 18 and the cavity 16, reaches a first predetermined level at which the shear pin 82 is designed to shear. In a preferred embodiment this first level equals a differential pressure of 1480 psi (±150 psi for 99% probability).

When the pressure differential reaches that first level the shear pin 82 shears and allows first piston 84 to move to its second position so that fluid may flow through first port means 58, second bore 56, and second port means 66 to outlet 30. The fluid flows through outlet 30, then through annular passage 126, and then through the narrow annular clearance 142, between lower packer shoe 38 and outer surface 40 of mandrel 18, to the annular space 22 between bladder means 20 and mandrel 18.

When the fluid under pressure from the interior 28 of mandrel 18 flows into the annular space 22 it inflates the bladder 20 from the uninflated position shown in FIGS. 2A and 2B to the inflated position shown in FIG. 1.

The annular space 22 will remain in fluid communication with the interior 28 of mandrel 18 until the pressure differential between the interior 28 and the cavity 16 reaches a second level at which the shear pin of second piston 84 is designed to shear and allow the second piston 84 to move to its second permanently locked position. When second piston 84 is in its second position the second port means 66 is permanently isolated from the interior 28 of mandrel 18 so that the bladder means 20 remains permanently inflated. The second level, at which the shear pin of the second piston shears, is higher than said first level of said pressure differential, and in a preferred embodiment of the present invention said second level is equal to 2000 psi (±200 psi for 99% probability).

An important feature of the present invention is that when the second valve 84 moves from its first position to its second position, to block second port means 66, there is no loss of fluid from annular space 22. The volume of second port means 66 when second piston 84 is in the first position of FIG. 4 is equal to a volume of said second port means 66 when second piston 84 is in its second position blocking port means 66. Automatic control valves for inflatable packers of the prior art have included means for automatically shutting off the supply of fluid to the inflatable packer, but those prior art control valve means have typically included a structure such as that of U.S. Pat. No. 3,524,503 to Baker having a sliding piston with one end in fluid communication with the annular space 22 so that when a certain pressure is reached within that annular space 22 the piston is moved to a closed position. However with such prior art designs the movement of the piston to the second closed position causes that end of the piston in communication with the annular space 22 to be moved away therefrom so as to allow a small amount of fluid to be lost from the annular space 22.

In the applications of the present invention where the fluid is typically a substantially incompressible fluid such as water or drilling mud and is under very high pressure in a deep oil well, the loss of even a very small amount of fluid, e.g. one cubic centimeter, can create a considerable loss of pressure within the annular space 22. Since the ability of the inflated packer 20 to support a column of fluid above packer 20 within the annular cavity 16 is directly related to the inflation pressure of the annular packer 20, this loss of pressure within the annular space 22 directly results in a lower design capacity of the inflatable packer.

Figure 6:
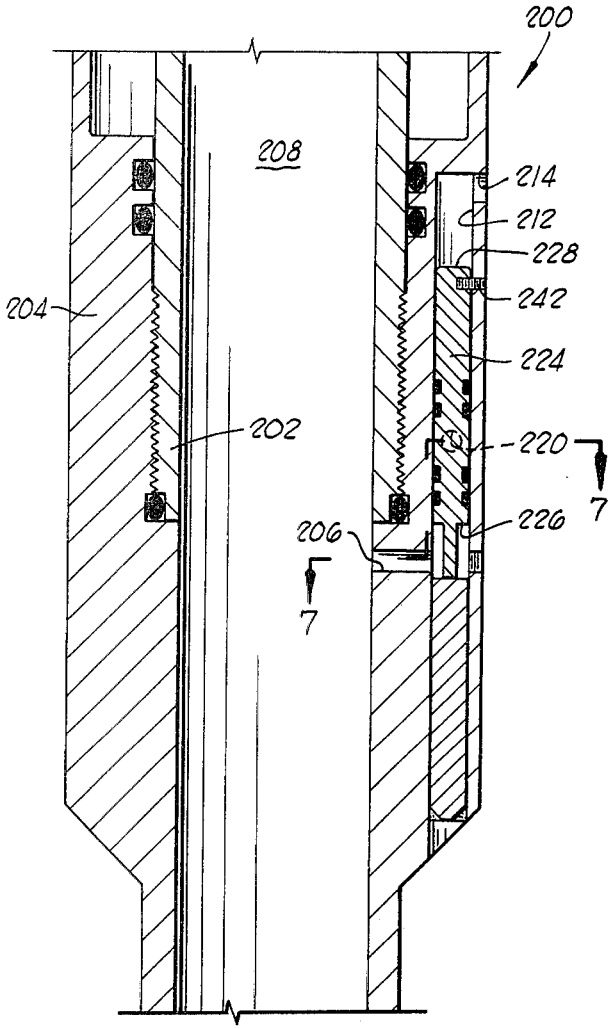
FIG. 6 is a sectional elevation view of an alternative embodiment of the control valve assembly of the present invention.
Figure 8:
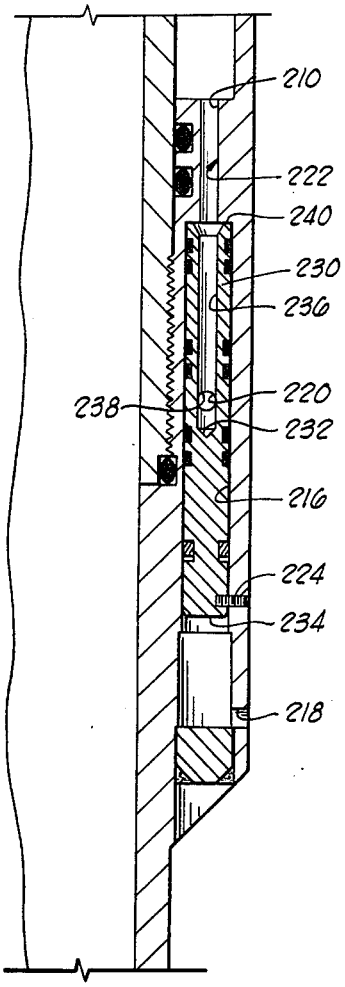
FIG. 8 is a sectional view taken along line 8—8 of FIG. 7.
Figure 7:
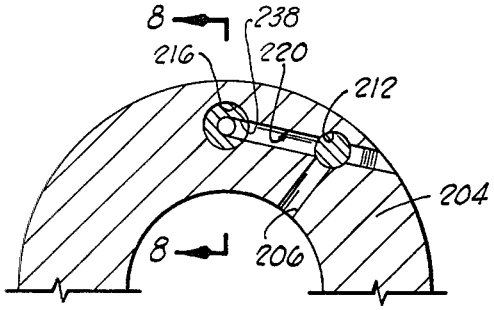
FIG. 7 is a partial sectional view taken along line 7—7 of FIG. 6.

While the embodiment of the present invention illustrated in FIGS. 1–5 is presently preferred, as alternative embodiment illustrated in FIGS. 6–8 has been developed which includes a secondary piston similar to the sliding piston of U.S. Pat. No. 3,524,503 to Baker. Although the embodiment of FIGS. 6–8 does have the disadvantage discussed above of a volume loss from annular space 22 upon closing of the secondary piston, it nevertheless provides many other desirable features of the embodiment of FIGS. 1–5.

The control valve assembly of FIGS. 6–8 is generally designated by the numeral 200. FIG. 6 is a view similar to FIG. 2C, showing a sectional elevation view of only the control valve assembly.

Control valve assembly 200 includes a mandrel 202 and a valve body 204 connected to mandrel 202. Valve body 204 includes an inlet means 206 for communicating with an interior of tubular member 12 through interior 208 of mandrel 202 and valve body 204.

Valve body 204 further includes an outlet means 210, see FIG. 8, for directing fluid to the bladder means 20. A first bore means 212 is disposed in valve body 204 for communicating inlet 206 with annular space 16 between tubular member 12 and well hole 14. First bore means 212 communicates with annular space 16 through a first relief hole 214 disposed substantially radially through a wall of said valve body 204.

A second bore means 216 is also disposed in valve body 204 and communicates with annular space 16 through a second relief hole 218.

A first port means 220 connects first and second bores 212 and 216. A second port means 222 connects second bore 216 and outlet 210.

A first piston 224 is disposed in first bore 212, and includes first and second ends 226 and 228, respectively, communicating with inlet 206 and annular space 16. First piston 224 is movable between a first position, illustrated in FIG. 6, blocking first port means 220, and a second position (displaced upward within bore 212) allowing fluid communication between inlet 206 and first port means 220.

A second piston 230 is disposed in second bore 216 and includes first and second ends 232 and 234, respectively, communicating with said first port means 220 and annular space 16, respectively, when second piston 230 is in its first position as illustrated in FIG. 8. Second piston 230 is movable to a second position (displaced downward within bore 216) blocking second port means 222.

Second piston 230 includes an axial blind bore 236 communicating with second port means 222, and a radial bore 238 communicating blind bore 236 with first port means 220 when second piston 230 is in its first position. When second piston 230 is moved to its second position, the radial bore 238 is moved out of registry with first port means 220.

The first end 232 of second piston 230, upon which the fluid pressure within both first and second port means 220 and 222 is applied when second piston 230 is in its first position, includes the blind end of blind bore 236 as indicated in FIG. 8. It also includes the annular end surface 240 at the uppermost end of second piston 230.

First and second pistons 224 and 230 are held in their first positions by shear pins 242 and 244, respectively, which operate similar to the manner previously described for the shear pins of the embodiment of FIGS. 1–5.

Thus, the inflatable packer assembly of the present invention is well adapted to obtain the advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A control valve assembly for a downhole tool, said downhole tool being constructed for connection to a tubular member to be lowered into a well hole; comprising:

a mandrel;

a valve body, connected to said mandrel, said valve body including:

an inlet means for communicating with an interior of said tubular member;

an outlet means, for directing fluid to a component of said downhole tool which is to be actuated by said fluid;

a first bore means, disposed in said valve body, for communicating said inlet with an annular space between said tubular member and said well hole;

a second bore means, disposed in said valve body, for communicating with said annular space;

a first port means, connecting said first and second bore means; and a second port means, connecting said second bore means and said outlet;

a first piston disposed in said first bore means, said first piston having first and second ends arranged for fluid communication with said inlet and said annular space, respectively, said first piston being movable between a first position blocking said first port means and a second position allowing fluid communication between said inlet and said first port means;

means for holding said first piston in said first position until a fluid pressure differential between said interior of said tubular member and said annular space reaches a first predetermined level, and for releasing said first piston so that it may be moved to said second position by said pressure differential when said differential reaches said first level;

a second piston disposed in said second bore means, said second piston having first and second ends arranged for fluid communication with said first port means and said annular space, respectively, said second piston being movable between a first position allowing fluid communication between said first and second port means and a second position blocking said second port means; and means for holding said second piston in its said first position until said fluid pressure differential reaches a second predetermined level, said second level being higher than said first level, and for releasing said second piston so that it may be moved to its second position by said pressure differential when said differential reaches said second level.

2. Apparatus of claim 1, wherein:

said valve body is further characterized as a cylindrical valve body having a first end surface for communicating with said annular space; and said first and second bore means include first and second axial bores, respectively, said axial bores communicating with said end surface of said valve body.

3. Apparatus of claim 2, wherein:

said cylindrical valve body is concentrically disposed about said mandrel; and said inlet of said cylindrical valve body is permanently aligned with a hole disposed through a wall of said mandrel.

4. Apparatus of claim 3, further comprising a removable means for blocking said hole in said wall of said mandrel.

5. Apparatus of claim 2, wherein said outlet of said valve body includes an annular axially extending groove communicating with a second end of said cylindrical valve body.

6. Apparatus of claim 2, wherein said cylindrical valve body is welded at its ends to said mandrel.

7. Apparatus of claim 2, wherein:

said cylindrical valve body further comprises a counterbore concentric with said second bore at said end surface of said valve body; and said second piston includes an expandable ring for engaging said counterbore and locking said second piston in its said second position.

8. Apparatus of claim 1, wherein: p1 said means for holding said first piston includes a first shear pin connecting said first piston to said valve body; and said means for holding said second piston includes a second shear pin connecting said second piston to said valve body.

9. Apparatus of claim 1, wherein said second piston includes a reduced diameter portion, so that when said second piston is in said first position said first and second port means are communicated through said second bore around said reduced diameter portion of said second piston.

10. Apparatus of claim 9, wherein a volume of said second port means when said second piston is in said first position is equal to a volume of said second port means when said second piston is in said second position.

11. Apparatus of claim 1, wherein a volume of said second port means when said second piston is in said first position is equal to a volume of said second port means when said second piston is in said second position.

12. Apparatus of claim 1, wherein said first piston includes a reduced diameter portion between said first and second ends thereof so that said first piston may bend when moving between said first and second positions within said first bore means.

13. Apparatus of claim 1, wherein said first and second bore means include first and second relief holes, respectively, for communicating with said annular space, said relief hole being disposed substantially radially through a wall of said valve body.

14. Apparatus of claim 1, wherein said second piston includes an axial blind bore communicating with said second port means and a radial bore for communicating said blind bore with said first port means when said second piston is in its said first position.

* * * * *